United States Patent [19]

Elliott

[11] 4,157,601

[45] Jun. 12, 1979

[54] FRONT SCREEN FOR CARDING MACHINES

[76] Inventor: Olin S. Elliott, 2011 Cleveland St., Greenville, S.C. 29607

[21] Appl. No.: 880,771

[22] Filed: Feb. 24, 1978

[51] Int. Cl.[2] ..... D01G 15/34

[52] U.S. Cl. ..... 19/95; 19/107

[58] Field of Search ..... 19/107, 95

[56] References Cited

U.S. PATENT DOCUMENTS 2,964,804 12/1960 Schonenberger ..... 19/107

FOREIGN PATENT DOCUMENTS 37-10880 8/1962 Japan ..... 19/107

355258 11/1972 U.S.S.R. ..... 19/107

*Primary Examiner*—Dorsey Newton

*Attorney, Agent, or Firm*—Bailey, Dority & Flint

[57] ABSTRACT

A front screen is illustrated having a nose portion extending from beneath the cylinder between the cylinder and the doffer wherein orifice means are provided for directing air under pressure forwardly therefrom for avoiding collection of fibers on the side and corner areas of the nose of the screen.

5 Claims, 2 Drawing Figures

Fig. 1.
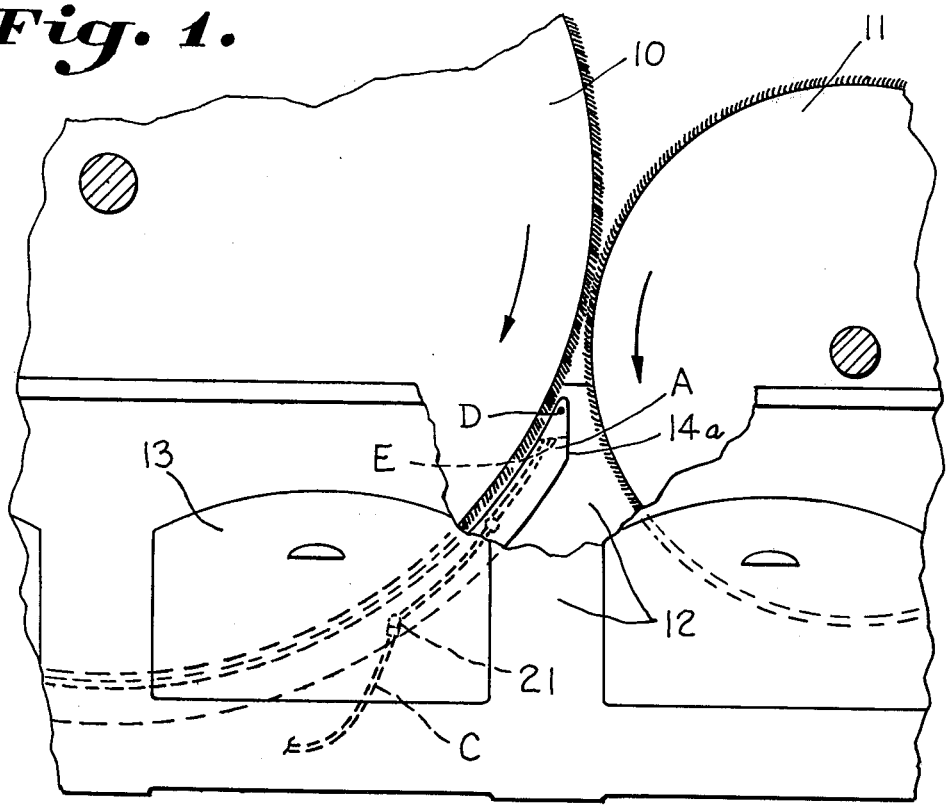
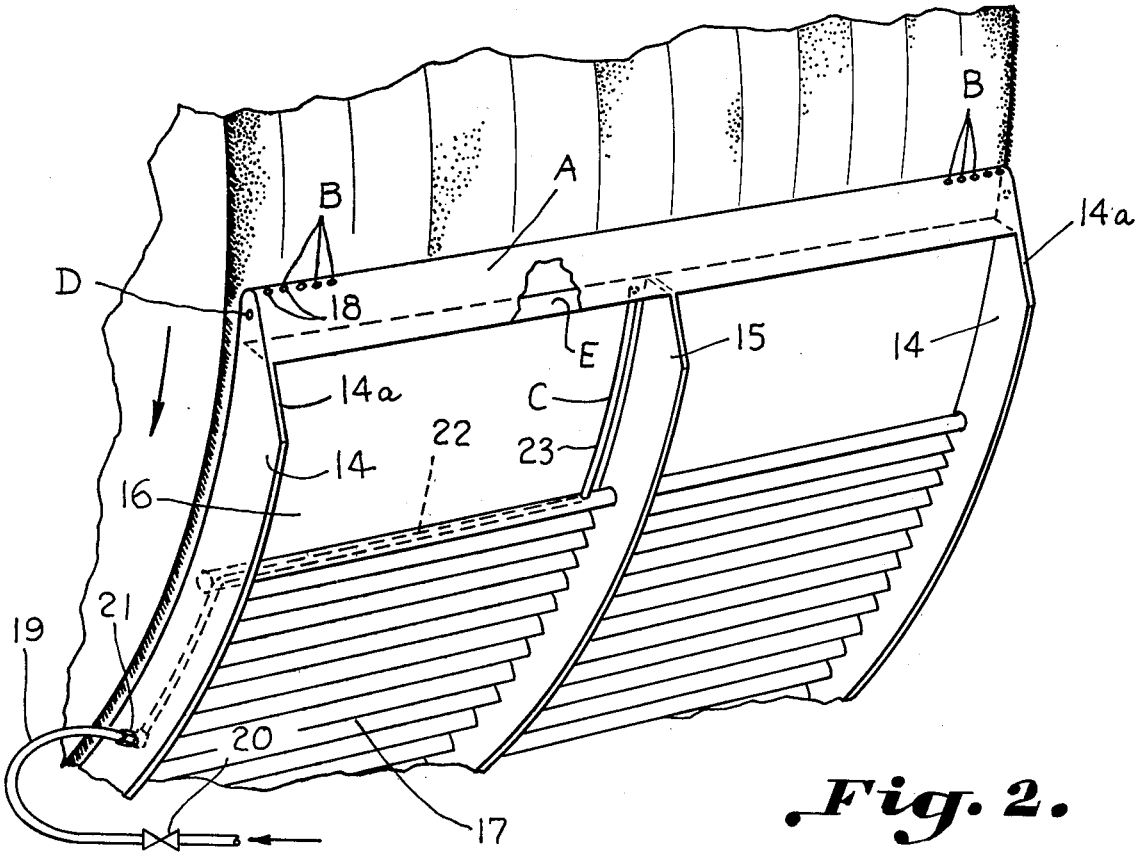
Fig. 2.

FRONT SCREEN FOR CARDING MACHINES

BACKGROUND OF THE INVENTION

Many efforts have been made in the past to solve the problem of fibers collecting to form chokes in the area of the nose of the front screen. Chokes in this area have always been recognized as a major cause of slubs and gouts in finished work creating excessive seconds in the work. Efforts which have been made in the past to solve this problem have included devices for directing air from the sides of the card inwardly toward the edge portions of the cylinder and card screen. Such air directed laterally inwardly seems to merely move the collection of fibers over towards the central portion of the screen rather than eliminate them.

Accordingly, it is an important object of this invention to provide an orifice means positioned adjacent the nose of the front screen in the marginal portions thereof adjacent the edges of the web to prevent a buildup of fibers in this area.

Another important object of this invention is to control and avoid the collection of fiber accumulations between the sides of the screen and the sides of the card in this area of the front screen.

Still another important object of the invention is to avoid excessive seconds by eliminating chokes in the area of the nose of the front screen while confining the web at the marginal portions thereof by controlled air flow to produce a web of improved yarn uniformity and quality.

SUMMARY OF THE INVENTION

It has been found that providing an orifice means adjacent the marginal portions of the nose of the front screen of a card that collection of fibers tending to form chokes in this area may be avoided and that the provision of an orifice adjacent each side of the nose of the front screen will avoid collection of fibers between the screen and the sides of the card frame and that this may best be achieved through enclosing at least a portion of the nose of the screen to form a plenum to permit air to flow under controlled pressures from spaced openings so as to avoid the undesirable collections of fibers.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a side elevation illustrating the nose portion of a screen constructed in accordance with the present invention positioned beneath and between the cylinder and doffer of a card, and FIG. 2 is a perspective view further illustrating the nose of the screen provided with orifice means for directing air flow in accordance with the present invention looking from the right-hand portion of FIG. 1.

DESCRIPTION OF A PREFERRED EMBODIMENT

The drawing illustrates a front screen for a carding machine having a cylinder and doffer carried between side frame members. A nose portion A extends forwardly from beneath the cylinder between the cylinder and the doffer and within the side frame members. Orifice means B extend adjacent a forward end of the nose portion at each side thereof. Means C connecting a source of compressed air to the orifice directing air forwardly therefrom for avoiding collection of fibers on the nose of the screen adjacent marginal portions of a web is provided at sufficiently low pressure as to avoid damage to the web. Orifice means D are connected to the source of compressed air adjacent each side end of the hose portion directing air laterally between said screen and said side frame members. A wall E substantially encloses at least a part of the nose portion except for the orifice means forming an air plenum.

Referring more particularly to FIG. 1, the carding machine illustrated has a main cylinder 10 and a doffer 11 positioned between spaced side frame members 12. It will be noted that the spaced side frame members 12 carry the usual cleanout doors 13. The nose A of the screen is carried beneath the cylinder and doffer and between them in the portion where the web is transferred from the cylinder to the doffer. The screen includes the usual side members 14 together with an intermediate bracing member 15 and a nose portion which extends forwardly of an imperforate plate 16 which extends rearwardly to the perforate portion 17 of the screen.

It is preferred that only the forwardmost portion of the nose A be incorporated plenum the pleunum by the provision of the wall E which encloses the forward portion of the nose. The orifice means B are illustrated in the form of spaced openings, preferably positioned across the very end of the nose portion but which may be spaced somewhat on either side thereof. The openings B are disposed in the marginal portions of the nose in the area adjacent the edges of the web which do not extend across the full width of the cylinder and in the marginal portions of the web there is a tendency towards non-uniformity which is believed to cause loose fibers to engage or bridge across the nose portion of conventional screens. The sides 14 are illustrated as tapering upwardly as at **14*a* to form a part of the nose of the card screen. The means for connecting the openings 18 which form the orifice means B may include a line 19 which has a flow valve 20 therein for regulating the amount of compressed air received from a source which is usually available adjacent the carding machines to a fitting 21 which extends through the side 14 in the area of a cleanout door 13. The line 19 extends to a line 22 and thence by line 23** to the medial portion of the plenum.

It is thus seen that a front screen having air flow in the marginal portions of the nose thereof has been provided to solve the problems relating to bridging of fibers in the area. This produces more even yarn by solving the problem of buildup and sloughing off of fibers in this area producing irregular yarn. The side areas of the screen and the frame are kept clear to avoid buildup in that area. The edges of the cylinder clothing outside the web are kept clean and the edges of the web are confined to produce a more well defined web which is highly advantageous in carding operations. Excessive down time is avoided since the card does not have to be stopped to remove chokes as often. Safety advantages are also provided in that since the card operates cleaner there is less tendency to reach in on the part of personnel to clean out areas adjacent the doffer. A better quality yarn is thus achieved through a carding operation which may be run more efficiently.

While a preferred embodiment of the invention has been described using specific terms, such description is for illustrative purposes only, and it is to be understood that changes and variations may be made without departing from the spirit or scope of the following claims.

What is claimed is:

1. A front screen for a carding machine having a cylinder and doffer carried between side frame members comprising:

a nose portion extending forwardly from beneath the cylinder between the cylinder and the doffer and within the side frame members;

orifice means in the marginal portions of the nose portion extending adjacent a forward end of the nose portion; and means connecting a source of compressed air to said orifice means directing air forwardly therefrom for avoiding collection of fibers on the nose of the screen adjacent marginal portions of a web but at sufficiently low pressure as to avoid damage to the web.

2. The structure set forth in claim 1, wherein said orifice means includes a plurality of spaced openings.

3. The structure set forth in claim 1, including orifice means connected to said source of compressed air adjacent each side end of the nose portion.

4. The structure set forth in claim 1, including a wall substantially enclosing at least a part of said nose portion except for said orifice means forming an air plenum.

5. The structure set forth in claim 4, wherein said means connecting a source of compressed air to said orifice means includes an air line connected centrally of said plenum connected to said source.

* * * * *